United States Patent [19]

Casinelli, deceased

[11] 4,385,619

[45] May 31, 1983

[54] PORTABLE STOVE

[76] Inventor: Dominic L. Casinelli, deceased, 2618 Glen Haven, Houston, Tex. 77025

[21] Appl. No.: 179,119

[22] Filed: Aug. 18, 1980

[51] Int. Cl.[3] ..... F24C 1/16

[52] U.S. Cl. ..... 126/9 B; 126/9 R; 126/38; 108/127; 248/188.6

[58] Field of Search ..... 126/9 R, 9 A, 9 B, 265, 126/254, 260, 222, 38, 49; 108/127; 248/188.6

[56] References Cited

U.S. PATENT DOCUMENTS

| | | | |
|---|---|---|---|
| 163,202 | 5/1875 | Houston . | |
| 165,444 | 7/1875 | Gorham et al. . | |
| 185,777 | 12/1876 | Pond . | |
| 299,713 | 6/1884 | Babbit et al. . | |
| 479,652 | 7/1892 | Marcee . | |
| 936,482 | 10/1909 | Seeley . | |
| 943,569 | 12/1909 | Scamardi . | |
| 1,199,257 | 9/1916 | Ferdon | 126/9 R |
| 1,487,377 | 3/1924 | Gaynor | 126/9 B |
| 1,518,650 | 12/1924 | Goldberg et al. . | |
| 1,812,967 | 7/1931 | Long | 108/127 |
| 1,991,135 | 2/1935 | Brown | 126/38 |
| 2,414,490 | 3/1944 | Speaker | 126/9 A |
| 2,498,682 | 2/1950 | Howard | 126/38 |
| 2,515,521 | 7/1950 | Loffredo | 126/9 R |
| 2,597,477 | 5/1952 | Haislip | 126/25 |
| 2,639,704 | 5/1953 | Gilchrist, Jr. | 126/43 |
| 2,836,476 | 5/1958 | Carter et al. | 311/84 |
| 3,327,698 | 6/1967 | Leslie | 126/9 R |
| 3,566,856 | 3/1971 | Linstead | 126/25 |
| 3,769,957 | 11/1973 | Ozaki | 126/9 |
| 3,877,458 | 4/1975 | Allander | 126/9 R |
| 3,911,892 | 10/1975 | Harris | 126/9 R |

FOREIGN PATENT DOCUMENTS

| | | | |
|---|---|---|---|
| 523111 | 3/1956 | Canada | 108/127 |
| 542652 | 10/1921 | France | 126/26 A |

*Primary Examiner*—Samuel Scott
*Assistant Examiner*—Randall L. Green
*Attorney, Agent, or Firm*—Frank S. Vaden, III; Marvin B. Eickenroht; Emil J. Bednar

[57] ABSTRACT

A portable stove for supporting stove utensil and heating same with a fuel element, including a support plate, plural support legs pivotally mounted with the support plate for supporting the same, a fuel receptacle with the support plate for receiving the fuel element for heating the stove utensils and spacer members with the support plate for spacing the stove utensils a predetermined distance from the upper surface of the support plate for proper heating thereof.

4 Claims, 4 Drawing Figures

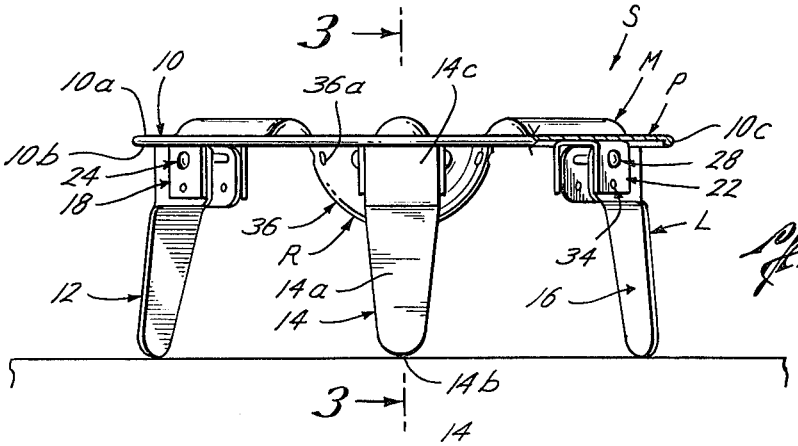
Fig. 1
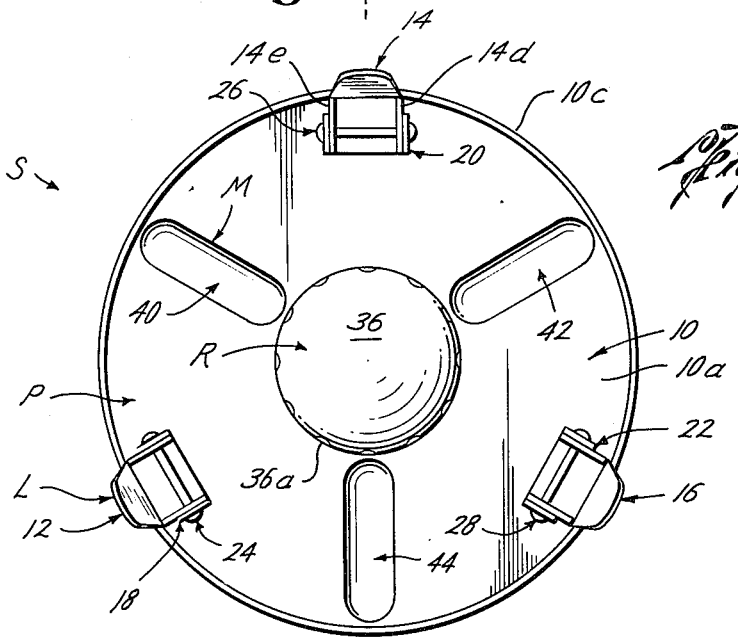
Fig. 2
Fig. 4
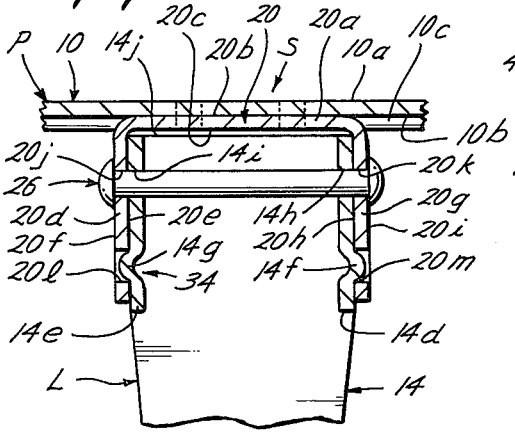
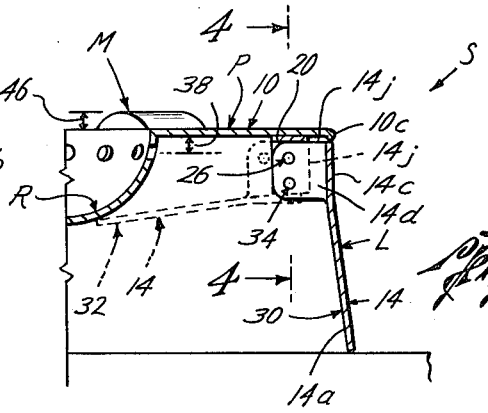
Fig. 3

PORTABLE STOVE

TECHNICAL FIELD

The technical field of this invention relates to stoves, particularly of the type that are portable and easily transported.

PRIOR ART

Stoves capable of being easily transported, assembled, and collapsed are well known in the art as shown by early U.S. Pat. Nos. 163,202; 165,444; 299,713; and, 479,652. Many later developed portable stoves include heater-cooker arrangements such as shown in U.S. Pat. Nos. 2,639,704; 3,327,698; and 3,769,957. As shown in the art, some references particularly detail locking mechanisms utilized for securing the foldable legs in a down and locked position such as those disclosed in U.S. Pat. Nos. 185,778; 943,569; 1,518,650; 2,597,477; 2,836,476; and 3,566,856. These references, in part detail the utilization of pivotally mounted supporting legs and having some type of feature for insuring that the legs once in a fully extended position, are locked and will not inadvertently collapse or be released unless such is desired.

Other references disclose utilization of a plurality of orifices or openings used to permit the ingress and egress of heat-smoke-air for use within and by the portable stove such as shown in U.S. Pat. No. 936,482. However, no portable stove is available, so far as is known, that is capable of supporting the fuel element used in heating the stove utensils at a predetermined location below the support plate yet having appropriate structure for spacing the cooking utensil from the surface of the support plate to not only insure positive air flow to the fuel element but also properly space the utensil from the flame of the fuel element and the support plate surface.

SUMMARY OF THE PRESENT INVENTION

The present invention relates to a new and improved portable stove for supporting the stove utensils and heating the same with a fuel element, the portable stove including a support plate having plural support legs pivotally mounted therewith for support thereof, a fuel receptacle with the support plate for receiving the fuel element for heating the stove utensils and spacer members with the support plate for spacing the stove utensils a predetermined distance from the upper surface of the support plate for proper heating thereof.

BRIEF DESCRIPTION OF THE DRAWINGS

FIG. 1 is a elevational view, partly in section, of the portable stove of the present invention;

FIG. 2 is a plan view of the portable stove of the present invention;

FIG. 3 is a sectional view, partly in elevation, taken along the lines 3—3 of FIG. 1; and, FIG. 4 is an enlarged sectional view of the locking means of the portable stove of the present invention.

DESCRIPTION OF THE PREFERRED EMBODIMENT

In the drawings, the portable stove of the present invention is designated generally by the letter S. The portable stove S is for supporting stove utensils and heating same with a fuel element and includes a support plate P, support legs L, a fuel receptacle R and spacer means M. Unless otherwise noted, the components of the portable stove S of the present invention are preferably formed of a suitable heat resistant yet heat transferable material such as a suitable metal or the like.

The portable stove S of the present invention includes a support plate P. The support plate P includes a plate 10 having an upper surface 10*a*, lower surface 10*b* and a downwardly, extending perimeter lip 10*c*. Preferably, the plate 10 is of generally of a circular configuration, however, any other suitable configuration may be used.

The portable stove of the present invention further includes a plurality of support legs L which include legs 12, 14, 16. Each of the legs 12, 14, 16 are substantially identical and have all component parts as described hereinafter with respect to leg 14. The leg 14 of the support legs L is shown in FIGS. 1 through 4. The support legs L preferably are pivotally mounted with the lower surface 10*b* of the plate 10 of the support plate P for supporting the support plate P. The support legs L such as leg 14 includes a depending portion 14*a* which preferably has a curved lower end 14*b*, with the depending portion 14*a* being preferably of a somewhat tapered configuration, with the taper increasing in width from the curved lower end to the upper portion 14*c* thereof.

Preferably, the leg 14 is formed having mounting flanges 14*d*, 14*e* formed with the upper portion 14*c* of the leg 14 and extending substantially perpendicular to the plane of the upper portion 14*c*. Each of the mounting flanges 14*d*, 14*e* is formed having a suitable locking tab 14*f*, 14*g* therewith, respectively as discussed more fully hereinbelow. Preferably, suitable, axially aligned openings 14*h*, 14*i* are formed in the mounting flanges 14*d*, 14*e*, respectively adjacent the upper portion 14*c* of the leg 14 of the support legs L. The leg 14 is formed having an upper surface 14*j* adjacent the upper end of the upper portion 14*c*.

The support legs L are pivotally mounted with the lower surface 10*b* of the plate 10 by means of suitable leg mounting brackets 18, 20, 22 which secure legs 12, 14, 16, respectively to the plate 10. As best seen in FIGS. 3 and 4, the leg mounting bracket 20, which is substantially identical to leg mounting brackets 18, 22, will be detailed for the purposes of explanation. Leg mounting bracket 20 preferably is of a generally U-shaped configuration. As best seen in FIG. 4, leg mounting bracket 20 has an upper portion 20*a*, having an upper surface 20*b* and a lower surface 20*c*, depending side portion 20*d* having an inner surface 20*e* and an outer surface 20*f*, and a depending side portion 20*g* having an inner surface 20*h* and an outer surface 20*i*. Thus the upper portion 20*a* and the depending side portions 20*d*, 20*g* generally define the U-shaped configuration of the leg mounting brackets 18, 20, 22 of the present invention.

Preferably, suitable axially aligned openings 20*j*, 20*k* are formed in depending side portions 20*d*, 20*g*, respectively and adapted to be axially aligned with openings 14*h*, 14*i*, respectively, of the leg 14. Suitable pivot pins 24, 26, 28, pivotally affix the legs 12, 14, 16 with the leg mounting brackets 18, 20, 22, respectively. As best shown in FIG. 4, pivot pin 26 is adapted to be disposed in aligned openings 20*j*, 14*i*, 14*h*, 20*k*, and in any suitable fashion, be secured with the leg mounting bracket 20 to permit pivotal movement of the leg 14 with respect to the leg mounting bracket 20. The leg mounting brackets 18, 20, 22 are secured to the lower surface 10*b* of the plate 10 in any suitable fashion which may include welding, gluing, bolting or any other suitable fashion.

The support legs L of the portable stove S of the present invention are movable between a retracted position and an extended position as best shown in FIG. 3, with the support legs L supporting the support plate P of the portable stove S when the support legs L are in the extended position designated as 30 in FIG. 3. The support legs L are then movable from the extended position 30 to the retracted position 32, which is shown in dashed lines in FIG. 3 and discussed more fully hereinbelow. The leg mounting brackets 18, 20, 22 are further formed having locking detents 20*l*, 20*m* formed in the depending side portions 20*d*, 20*g*, respectively, which may be openings, or any other suitable formed detent. As such, the locking detents 20*l*, 20*m* are adapted to receive the locking tabs 14*g*, 14*f*, respectively of the support legs L, when the support legs L are in the extended position 30 for releasably securing the support legs L in the extended position. As such, it is preferred that the inherent resiliency of the material of the support legs L be such that the mounting flanges 14*d*, 14*e* have suitable flex to allow flexure thereof permitting the mounting flanges 14*d*, 14*e* to move inwardly with respect to one another upon the locking tabs 14*f*, 14*g* engaging the inner surfaces 20*h*, 20*e* of depending side portions 20*g*, 20*d*, respectively, until such engages the respective locking detents 20*m*, 20*l*, respectively. Thus, when fully extended, the locking tabs 14*f*, 14*g* are in full engagement with the locking detents 20*m*, 20*l* for securing the support legs L in the extended position.

Should it be desirable to collapse the support legs L into the retracted position 32, then force applied adjacent the depending portion 14*a* of the leg 14 permits sufficient torque to be generated about the pin 26 to resiliently force the locking tabs 14*f*, 14*g* inwardly with respect to one another and out of their respective locking detents 20*m*, 20*l*, respectively to permit the leg 14 to pivot about the pin 26 to the retracted position 32. It should be noted further that when the support leg L is in the extended position 30, that the upper surface 14*j* of the leg 14 preferably engages the lower surface 20*c* of the upper portion 20*a* of the leg mounting bracket 20 for providing additional support thereof. Also, when in the extended position the support leg L further engages the bottom portion of the perimeter lip 10*c* of the plate 10 as best seen in FIG. 3. It will be appreciated that the locking tabs 14*f*, 14*g* and the locking detents 20*l*, 20*m* form the locking means 34 of the present invention. Further, it will be appreciated that the exterior surface of the mounting flanges 14*d*, 14*e* of leg 14 of the support legs L are preferably curved (FIG. 3) to permit unrestrained rotation of the leg 14 about the pivot pin 26 during movement between the extended position 30 and the retracted position 32. Further, it will also be appreciated that when the support legs L are in a retracted position 32 as best shown in FIG. 3 that the support legs L come into engagement with the lower end of the fuel receptacle R.

The portable stove S of the present invention further includes a fuel receptacle R with the support plate S for receiving a fuel element (not shown) for heating the stove utensils and their contents. The fuel receptacle R includes receptacle 36 which may be of a cupped-like, semi-globular configuration or any other suitable configuration. Preferably the full receptacle R extends below the lower surface 10*b* of plate 10 and may be formed having a plurality of openings, such as opening 36*a*, about the upper portion of the receptacle 36 adjacent to the mounting of the receptacle 36 with the support plate P. The receptacle 36 may be formed with the support plate P as an integral unit as shown in the FIGS. 1–3. Alternatively the receptable 36 may be removably affixed to the support plate P in any suitable fashion, such as by way of threaded engagement therebetween, and/or a suitable opening (not shown) formed in the support plate P and an appropriate depending lip (not shown) formed about the upper end of the receptacle 36 permitting the receptacle 36 to hang in such a suitably formed opening, or in any other suitable fashion secured to and/or formed with the support plate P. The receptacle 36 is adapted to receive a suitable fuel element (not shown) which may be of any particular type. The portable stove S of the present invention is most particularly adapted to be used with the fuel element to my co-pending United States patent application entitled "SOLID FUEL COMPOSITION", Ser. No. 179,118 filed Aug. 18, 1980 and now issued as U.S. Pat. No. 4,286,968 on Sept. 1, 1981, filed concurrently with this application. It is preferred that the openings 36*a* are provided in the receptacle 36 for permitting proper amounts of air to flow to the fuel element for combustion thereof. Preferably, the openings are spaced a predetermined amount, designated by the arrow 38 in FIG. 3 below the lower surface 10*b* of the plate 10 for enhanced combustion of the fuel element (not shown) in the receptacle 36. Alternatively, the preferred spacing may be measured from the base of the receptacle 36 to the openings 36*a*. It should be understood that the predetermined amount 38 is of extreme importance in controlling the proper burn of the fuel element and thus, the number, the location and size of the openings 36*a* formed in the receptacle 36 are of the utmost importance in insuring a properly heating portable stove S.

The portable stove S further includes spacer means M. Preferably, the spacer means M includes a spacer projection such as spacer projections 40, 42, 44, which extend upwardly from the upper surface 10*a* of the plate 10 a predetermined distance designated by the arrow 46 in FIG. 3. The spacer projections 40, 42, 44 may be formed with the support plate P or independent thereof. As best seen in FIG. 2, the spacer projections 40, 42, 44 preferably extend radially outwardly from the fuel receptacle R to the perimeter lip 10*c* of the plate 10. The cooking utensils (not shown) are adapted to be placed upon the portable stove S in such a fashion that the spacer projections 40, 42, 44 of the spacer means M support such cooking utensils. The predetermined distance 46 from the upper surface 10*a* of the support plate P permits proper circulation of the combustion flame from the fuel element (not shown) onto the cooking utensil as well as providing a passageway for sufficient circulation of the heated air about the bottom portion of the cooking utensil placed upon the portable stove S. Thus, the predetermined distance 46 insures properly spaced location of the cooking utensil from the upper surface 10*a* of the support plate P while the predetermined amount 38 insures proper air flow across the burner element in the fuel receptacle R for insuring proper burning of the fuel element in using the portable stove S of the present invention.

Thus, the portable stove S of the present invention provides a new and improved portable stove for supporting and heating stove utensils.

The foregoing disclosure and description of the invention are illustrative and explanatory thereof and various changes in the size, shape and materials as well as in the details of the preferred embodiments may be made without departing from the spirit of the invention.

I claim:

1. A portable stove for supporting stove utensils and heating same with a fuel element, comprising:

a support plate having an upper planar surface and a lower planar surface;

plural support legs pivotally mounted with said lower surface of said support plate, said support legs for supporting said support plate;

a fuel receptacle provided by a cupped member carried integrally with said support plate for receiving the fuel element for heating the stove utensils; and said cupped member only extending below said lower planar surface of said support plate; said fuel receptacle extending below said lower surface of said support plate and being formed having a plurality of openings for permitting proper amounts of air to flow to the fuel element for combustion thereof, said openings being spaced above the bottom of said fuel receptacle and a predetermined amount below said lower surface of said support plate for enhanced combustion of the fuel element, and spacer means associated with said support plate for spacing the stove utensil a predetermined distance from said upper surface of said support plate for proper heating thereof and said spacer means provided by raised members carried integrally by said support plate and extending only above said upper planar surface.

2. The portable stove of claim 1, wherein said fuel receptacle is formed with said support plate.

3. A portable stove for supporting stove utensils and heating same with a fuel element, comprising:

a sheet metal support plate having upper and lower surfaces;

a plurality of support legs pivotly mounted onto said lower surface of said support plate adjacent its perimeter, said support legs in an extended position supporting said support plate in an operative position for heating utensils;

a fuel receptacle provided by a downwardly extending cupped depression formed integrally within the center of said support plate between said support legs, said fuel receptacle receiving a fuel element for heating stove utensils, a plurality of openings being provided within said cupped depression of said support plate forming said fuel receptacle, said openings being spaced above the bottom of said cupped depression and a predetermined distance below said lower surface of said support plate thereby permitting proper amounts of air inflow for enhancing combustion of said fuel element; and spacer means provided by a plurality of projections extending upwardly at uniform height from said upper surface and formed integrally within said support plate, said projections disposed about said fuel receptacle for spacing stove utensils a predetermined distance from said upper surface of said support plate for proper heating thereof by a fuel element in said fuel receptacle.

4. A portable stove for supporting stove utensils and heating same with a fuel element comprising:

a circular sheet metal support plate having upper and lower surfaces;

a fuel receptacle provided by a downwardly extending cupped depression formed integrally within the center of said support plate, said receptacle receiving a fuel element for heating stove utensils;

a plurality of sheet metal support legs pivotly mounted by sheet metal brackets onto said lower surface of said support plate adjacent its circular perimeter, said support legs in an extended position supporting said support plate in an operative position for heating utensils and in a retracted position to rest with the free ends of said legs in contact with said cupped depression in said support plate;

said mounting brackets formed in a u-shape and mounted integrally to said lower surface of said support plate, and said support legs at their upper ends formed into flanges to enter said brackets and to be pivotly mounted therein by transverse pivot pins, said flanges on said legs and said mounting brackets having detent means for releasealy locking said legs into their extended positions, and positive stops provided by upper leg surfaces engaging lower bracket surfaces upon said legs reaching their extended positions;

spacer means provided by a plurality of semicylindrical projections extending radially from said fuel receptacle to adjacent the circular perimeter of said support plate, said projections extending upwardly at uniform height from said upper surface and formed integrally as ridges within said support plate for spacing stove utensils a predetermined distance from said upper surface of said support plate for proper heating by a fuel element in said fuel receptacle; and a plurality of openings provided within said cupped depression in said support plate forming said fuel receptacle, said openings spaced above the bottom of said cupped depression and a predetermined distance below said lower surface of said support plate thereby permitting proper amounts of air inflow for enhancing combustion of the fuel element.

* * * * *